US011622421B2

(12) United States Patent
Ohse et al.

(10) Patent No.: US 11,622,421 B2
(45) **Date of Patent: *Apr. 4, 2023**

(54) ELECTRIC HEATERS WITH LOW DRIFT RESISTANCE FEEDBACK

(71) Applicant: Watlow Electric Manufacturing Company, St. Louis, MO (US)

(72) Inventors: Jeremy Ohse, St. Louis, MO (US); Jake Spooler, Hannibal, MO (US); Philip S. Schmidt, Winona, MN (US); Patrick Margavio, Columbia, MO (US); Melissa Lanham, Frankford, MO (US); Paul Valachovic, Fenton, MO (US); Brittany Phillips, St. Louis, MO (US); Mark Denis Everly, St. Charles, MO (US)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 599 days.

This patent is subject to a terminal disclaimer.

(21) Appl. No.: 16/600,742

(22) Filed: Oct. 14, 2019

(65) Prior Publication Data

US 2020/0045775 A1 Feb. 6, 2020

Related U.S. Application Data

(63) Continuation of application No. 15/790,301, filed on Oct. 23, 2017, now Pat. No. 10,448,458.

(Continued)

(51) Int. Cl.

*H05B 1/02* (2006.01)
*H05B 3/00* (2006.01)

(Continued)

(52) U.S. Cl.

CPC ..... *H05B 1/0288* (2013.01); *H05B 3/0014* (2013.01); *H05B 3/12* (2013.01);

(Continued)

(58) Field of Classification Search

CPC ..... H05B 1/0288; H05B 3/0014; H05B 3/12; H05B 3/44; H05B 2203/005; H05B 2203/037

See application file for complete search history.

(56) References Cited

U.S. PATENT DOCUMENTS 2,767,288 A 10/1956 Lennox
4,419,302 A * 12/1983 Nishino ..... A61M 11/042 261/DIG. 65

(Continued)

FOREIGN PATENT DOCUMENTS

CN 85104121 10/1986
CN 101077035 11/2007

(Continued)

*Primary Examiner* — Shawntina T Fuqua
(74) *Attorney, Agent, or Firm* — Burris Law, PLLC

(57) ABSTRACT

A heater system is provided. The system includes a resistive element with a temperature coefficient of resistance (TCR) of at least about 1,000 ppm such that the resistive element functions as a heater and as a temperature sensor and the resistive element is a material having greater than about 95% nickel. The system also includes a heater control module including a two-wire controller with a power control module that is configured to periodically compare a measured resistance value of the resistive element against a reference temperature to adjust for resistance drift over time during operation such that a temperature drift of the resistive element is less than about 1% over a temperature range of about 500° C.-1,000° C.

20 Claims, 7 Drawing Sheets

Related U.S. Application Data

(60) Provisional application No. 62/411,202, filed on Oct. 21, 2016, provisional application No. 62/411,197, filed on Oct. 21, 2016.

(51) Int. Cl.
*H05B 3/12* (2006.01)
*H05B 3/44* (2006.01)

(52) U.S. Cl.
CPC ..... *H05B 3/44* (2013.01); *H05B 2203/005* (2013.01); *H05B 2203/037* (2013.01)

(56) References Cited

U.S. PATENT DOCUMENTS

| | | | | |
|---|---|---|---|---|
| 5,552,998 | A | 9/1996 | Datta | |
| 6,850,859 | B1 | 2/2005 | Schuh | |
| 7,196,295 | B2 * | 3/2007 | Fennewald | B29C 45/2737 219/241 |
| 7,601,935 | B2 | 10/2009 | Fennewald et al. | |
| 7,944,270 | B2 | 5/2011 | Denier et al. | |
| 9,123,755 | B2 * | 9/2015 | Swanson | H01L 21/6833 |
| 9,320,084 | B2 * | 4/2016 | Weiss | H05B 3/146 |
| 10,361,103 | B2 | 7/2019 | Smith et al. | |
| 10,448,458 | B2 * | 10/2019 | Ohse | H05B 1/0288 |
| 2005/0109767 | A1 | 5/2005 | Fennewald et al. | |
| 2008/0197856 | A1 | 8/2008 | Schnaibel et al. | |
| 2017/0069514 | A1 * | 3/2017 | Nosrati | C04B 37/021 |
| 2018/0124870 | A1 * | 5/2018 | Ohse | H05B 3/0014 |
| 2021/0265085 | A1 * | 8/2021 | Fesshaie | H05B 3/262 |

FOREIGN PATENT DOCUMENTS

| | | |
|---|---|---|
| CN | 101589644 | 11/2009 |
| CN | 102047752 | 5/2011 |
| CN | 104025702 | 9/2014 |
| DE | 102007040891 | 4/2009 |
| EP | 0300685 | 1/1989 |
| JP | S61-120191 | 7/1986 |
| JP | S63-054962 | 4/1988 |
| JP | S6435889 | 2/1989 |
| JP | 2001188547 | 7/2001 |
| JP | 2004303736 | 10/2004 |
| JP | 2008503813 | 2/2008 |
| JP | 2008537668 | 9/2008 |
| JP | 2014525662 | 9/2014 |
| KR | 20110091349 | 8/2011 |
| TW | I685275 | 2/2020 |

* cited by examiner

ELECTRIC HEATERS WITH LOW DRIFT RESISTANCE FEEDBACK

CROSS-REFERENCE TO RELATED APPLICATIONS

This application is a continuation of U.S. application Ser. No. 15/790,301 filed on Oct. 23, 2017, which claims priority to and the benefit of U.S. Provisional Patent Application 62/411,197 filed Oct. 21, 2016 and U.S. Provisional Patent Application 62/411,202 filed Oct. 21, 2016. The disclosures of the above applications are incorporated herein by reference.

FIELD

The present application relates to electric heaters, and more particularly to electric heaters with improved temperature sensing capabilities.

BACKGROUND

The statements in this section merely provide background information related to the present disclosure and may not constitute prior art.

Tubular heaters, cartridge heaters, and cable heaters are tube-like heaters, which are generally used in applications where space is limited. If needed, one or more temperature sensors may be connected to the heaters to measure and monitor the temperature of the heaters and/or a surrounding environment. The temperature sensors and associated wires for connecting the temperature sensors to an external control system can consume valuable space that is reserved for the heaters, making installation of the heaters more difficult. This is particularly true when multiple heaters with multiple sensors are installed.

SUMMARY

In one form of the present disclosure, a heater system is provided. The system comprises a resistive element with a temperature coefficient of resistance (TCR) of at least about 1,000 ppm such that the resistive element functions as a heater and as a temperature sensor, the resistive element being a material having greater than about 95% nickel. The system further comprises a heater control module including a two-wire controller with a power control module that is configured to periodically compare a measured resistance value of the resistive element against a reference temperature to adjust for resistance drift over time during operation such that a temperature drift of the resistive element is less than about 1% over a temperature range of about 500° C.-1,000° C.

In another form of the present disclosure, the system further comprises an insulation material surrounding the resistive element and a sheath surrounding the insulation material. In some of these forms, the insulation material includes MgO and the sheath is a metal material.

In at least one form of the present disclosure, the resistive element further comprises a coating material selected from the group consisting of Nickel, Nickel alloys, Nickel-Chromium alloys, Iron-Chromium-Aluminum alloys, nickel aluminides, Cobalt alloys, Iron alloys, and precious metals.

In at least one form of the present disclosure, the system further comprises a plurality of resistive elements having a TCR of at least about 1,000 ppm and being a material having greater than about 95% nickel. In some of these forms, the system further comprise a power control module having a plurality of power nodes, wherein each resistive element is connected between a first power node and a second power node of the plurality of power nodes, and each resistive element is connected with an addressable switch configured to activate and deactivate the resistive element. Also, each resistive element is independently controlled by the control system. In some forms, a power control module having at least three power nodes is included, wherein a resistive element of the plurality of resistive elements is connected between each pair of power nodes. In other forms, a power control module having a plurality of power nodes is included and a first resistive element and a second resistive element of the plurality of resistive elements is connected between a first node and a second node. The first resistive element is activated and the second resistive element is deactivated by a first polarity of the first node relative to the second node, and the first resistive element is deactivated and the second resistive element is activated by a second polarity of the first node relative to the second node.

In another form of the present disclosure, the system comprises a plurality of resistive elements having a TCR of at least about 1,000 ppm and being a material having greater than about 95% nickel, and a plurality of independently controllable zones with each independently controllable zone including at least one of the plurality of resistive elements.

In at least one form of the present disclosure, the resistive element is a material selected from the group consisting of nickel, a nickel copper alloy, stainless steel, a molybdenum-nickel alloy, niobium, a nickel-iron alloy, tantalum, zirconium, tungsten, molybdenum, stainless steel, Nisil, and titanium.

In numerous forms of the present disclosure, the resistive element is formed by a layered process.

In another form of the present disclosure, a heater system includes a plurality of resistive elements having a TCR of at least about 1,000 ppm and being a material having greater than about 95% nickel such that each resistive element functions as a heater and as a temperature sensor. The heater system also includes a heater control module including a two-wire controller with a power control module having a plurality of power nodes. The power control module is configured to periodically compare a measured resistance value of each of the resistive elements against a reference temperature to adjust for resistance drift over time during operation such that a temperature drift of each of the plurality of resistive elements is less than about 1% over a temperature range of about 500° C.-1,000° C.

In at least one form of the present disclosure, each resistive element is connected between a first power node and a second power node of the plurality of power nodes and each resistive element is connected with an addressable switch configured to activate and deactivate the resistive element. In such a from, each resistive element is independently controlled by the power control module.

In some forms of the present disclosure, a first resistive element and a second resistive element of the plurality of resistive elements are connected between a first node and a second node. The first resistive element is activated and the second resistive element is deactivated by a first polarity of the first node relative to the second node, and the first resistive element is deactivated and the second resistive element is activated by a second polarity of the first node relative to the second node. In some forms, the heater system further includes a plurality of independently controllable zones and each independently controllable zone includes at least one of the plurality of resistive elements.

In at least one form an insulation material surrounding each of the plurality of resistive elements and a sheath surrounding the insulation material. In some variations the insulation material includes MgO and the sheath is a metal material.

In yet another form of the present disclosure, a heater for use in a heater system is provided. The heater comprises a resistive element with a temperature coefficient of resistance (TCR) of at least 1,000 ppm such that the resistive element functions as a heater and as a temperature sensor. The resistive element is a material having greater than about 95% nickel and a heater control module includes a two-wire controller with a power control module that periodically compares a measured resistance value of the resistive element against a reference temperature to adjust for resistance drift over time during operation such that a temperature drift of the resistive element is less than about 1% over a temperature range of about 500° C.-1,000° C.

In at least one form of the present disclosure, the heater further comprises a plurality of resistive elements connected between a first power node and a second power node of a plurality of power nodes, and each resistive element is connected with an addressable switch configured to activate and deactivate the resistive element. Also each resistive element is independently controlled by a power control module.

In one form of the present disclosure, the resistive element comprises a coating material selected from the group consisting of nickel, nickel alloys, nickel-chromium alloys, iron-chromium-aluminum alloys, nickel aluminides, cobalt alloys, iron alloys, and precious metals.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

DETAILED DESCRIPTION

The following description is merely exemplary in nature and is not intended to limit the present disclosure, application, or uses. For example, the following forms of the present disclosure may be used with electrostatic chucks or heat exchangers in semiconductor processing. However, it should be understood that the heaters and systems provided herein may be employed in a variety of applications and are not limited to semiconductor processing applications.

Figure 1:
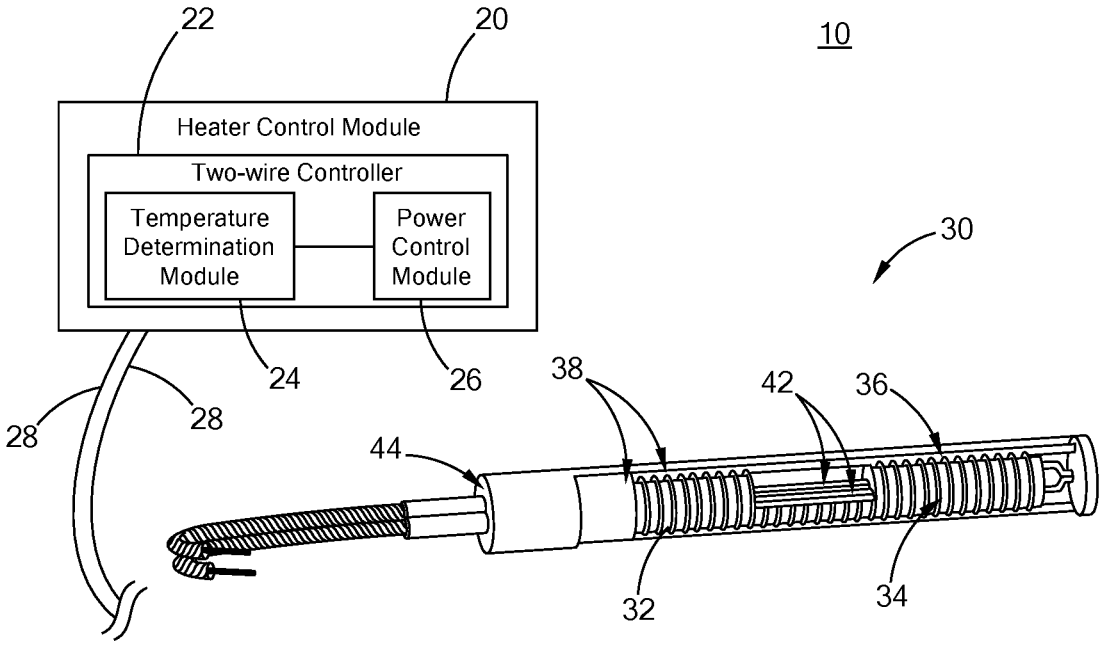
FIG. 1 is a schematic view of a heater system including a heater control module and a cartridge heater according to one form of the present disclosure.
Figure 2:
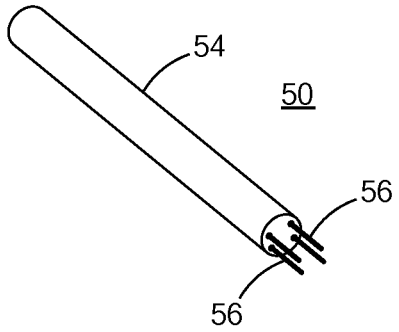
FIG. 2 is a perspective view of a cartridge heater according to another form of the present disclosure.
Figure 3:
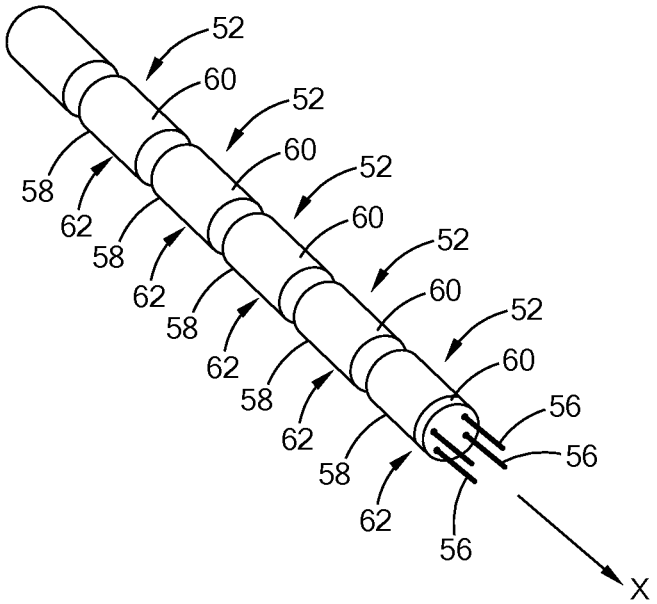
FIG. 3 is a perspective view of a cartridge heater having multiple zones, wherein an insulating material and an outer sheath are removed for clarity.
Figure 4:
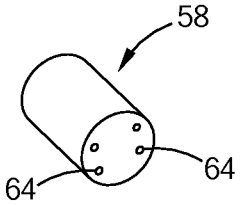
FIG. 4 is a perspective view of a heater unit of FIG. 3.

Referring to FIG. 1, a heater system 10 in accordance with one form of the present disclosure includes a heater control module 20 and a heater 30. The heater control module 20 includes a two-wire controller 22 including a temperature determination module 24 and a power control module 26. The two-wire controller 22 is in communication with the heater 30 through a pair of electrical leads 28. The heater 30 may be a cartridge heater 30 and generally includes a core body 32, a resistive element 34 in the form of a resistive wire wrapped around the core body 32, a metal sheath 36 enclosing the core body 32 and the resistive element 34 therein, and an insulating material 38 filling in the space in the metal sheath 36 to electrically insulate the resistive element 34 from the metal sheath 36 and to thermally conduct the heat from the resistive element 34 to the metal sheath 36. The core body 32 may be made of ceramic. The insulation material 38 may be compacted Magnesium Oxide (MgO), and more specifically, at least 50% MgO in one form of the present disclosure. A plurality of power conductors 42 extend through the core body 32 along a longitudinal direction and are electrically connected to the resistive element 34. The power conductors 42 also extend through an end piece 44 that seals the outer sheath 36. The power conductors 42 are connected to the two-wire controller 22 via the pair of electrical leads 28. Various constructions and further structural and electrical details of cartridge heaters are set forth in greater detail in U.S. Pat. Nos. 2,831,951 and 3,970,822, which are commonly assigned with the present application and the contents of which are incorporated herein by reference in their entirety. Therefore, it should be understood that the form illustrated herein is merely exemplary and should not be construed as limiting the scope of the present disclosure. Additionally, other types of heaters besides the cartridge heater 30 shown in FIG. 1 may be employed according to the teachings of the present disclosure, which are described in greater detail below.

The two-wire controller 22, which is in one form is microprocessor based, includes a temperature determination module 24 and a power control module 26. The heater 30 is connected to the two-wire controller as shown through a single set of electrical leads 28. Power is provided to the heater 30 through the electrical leads 28, and temperature information of the heater 30 is provided on command to the two-wire controller 22 through the same set of electrical leads 28. More specifically, the temperature determination module 24 determines the temperature of the heater 30 based on a calculated resistance of the resistive element 34, and then sends signals to the power control module 26 to control the temperature of the heater 30 accordingly. Therefore, only a single set of electrical leads 28 is required rather than one set for the heater and one set for a temperature sensor.

In order for the resistive element 34 to serve both the function of a temperature sensor in addition to a heater element, the resistive element 34 is a material having a relatively high temperature coefficient of resistance (TCR). As the resistance of metals increases with temperature, the resistance at any temperature t (° C.) is:

$$R=R_0(1+\alpha t) \quad \text{(Equation 1)}$$

where: $R_0$ is the resistance at some reference temperature (often 0° C.) and $\alpha$ is the temperature coefficient of resistance (TCR). Thus, to determine the temperature of the heater, a resistance of the resistive element 34 is calculated by the two-wire controller 22. In one form, the voltage across and the current through the resistive element 34 is measured using the two-wire controller 22, and a resistance of the resistive element 34 is calculated based on Ohm's law. Using Equation 1, or similar equations known to those skilled in the art of temperature measurement using Resistance Temperature Detectors (RTDs), and the known TCR, temperature of the resistive element 34 is then calculated and used for heater control.

Therefore, in one form of the present disclosure, a relatively high TCR is used such that a small temperature change results in a large resistance change. Therefore, formulations that include materials such as platinum (TCR=0.0039Ω/Ω/° C.), nickel (TCR=0.0041Ω/Ω/° C.), or copper (TCR=0.0039Ω/Ω/° C.), and alloys thereof, are used for the resistive element 34. A two-wire heater control system has been disclosed in U.S. Pat. Nos. 7,601,935, 7,196,295, and 8,378,266, which are commonly assigned with the present application and the contents of which are incorporated herein by reference in their entirety.

In another form, the material of the resistive element 34 has a negative change in electrical resistivity with increasing temperature over a temperature range at least partly overlapping the operating temperature range of the resistive element 34. Functionality of the resistive element 34 with this material is described in greater detail in U.S. patent application Ser. No. 15/447,994 titled "HEATER ELEMENT HAVING TARGETED DECREASING TEMPERATURE RESISTANCE CHARACTERISTICS," which is commonly assigned with the present application and the contents of which are incorporated herein by reference in their entirety.

The resistive element 34 may include a material selected from the group consisting of nickel, nickel copper (e.g., Monel® brand), stainless steel, (e.g. 304L) a molybdenum-nickel alloy, niobium, a nickel-iron alloy, tantalum, zirconium, tungsten, molybdenum, Nisil (nickel-silicon with traces of Mg), and titanium, and combinations thereof, among others. The resistive element 34 having a relatively high TCR enables resistance feedback control via only two wires (i.e., the pair of electrical leads 28).

For example, a TCR of at least about 1,000 ppm is employed, and a temperature drift of less than about 1% over a temperature range of about 500° C. -1,000° C. over a variety of operating ranges is contemplated by the teachings of the present disclosure.

Referring to FIGS. 2 to 5, the heater 50 may be in the form of a cartridge heater 50 having a configuration similar to that of FIG. 1 except for the number of core bodies and number of power conductors used. More specifically, the cartridge heater 50 each include a plurality of heater units 52, and an outer metal sheath 54 (shown only in FIG. 2) enclosing the plurality of heater units 52 therein, along with a plurality of power conductors 56. An insulating material (not shown in FIGS. 2 to 5) is provided between the plurality of heating units 52 and the outer metal sheath 54 to electrically insulate the heater units 52 from the outer metal sheath 54. The plurality of heater units 52 each include a core body 58 and a resistive heating element 60 (clearly shown in FIG. 5) surrounding the core body 58. The resistive heating element 60 of each heater unit 52 may define one or more heating circuits to define one or more heating zones 62.

In the present form, each heater unit 52 defines one heating zone 62 and the plurality of heater units 52 are aligned along a longitudinal direction X. Therefore, the cartridge heater 50 defines a plurality of heating zones 62 aligned along the longitudinal direction X. The core body 58 of each heater unit 52 defines a plurality of through holes/apertures 64 to allow power conductors 56 to extend therethrough.

The resistive heating elements 60 of the heater units 52 are connected to the power conductors 56, which, in turn, are connected to the heater control module 20 (shown in FIG. 1). The power conductors 56 supply the power from the power control module 26 including a power supply device (not shown) to the plurality of heater units 50. By properly connecting the power conductors 56 to the resistive elements 60 and by properly supplying power to only some of all of the power conductors 56, the resistive elements 60 of the plurality of heating units 52 can be independently controlled by the power control module 26 of the heater control module 20. As such, failure of one resistive element 60 for a particular heating zone 62 will not affect the proper functioning of the remaining resistive elements 60 for the remaining heating zones 62. Moreover, the heating zones 62 can be independently controlled to provide a desired heating profile.

In the present form, four power conductors 56 are used for the cartridge heater 50 to supply power to six independent electrical heating circuits on the six heater units 52. It is possible to have any number of power conductors 56 to form any number of independently controlled heating circuits and independently controlled heating zones 62.

Figure 5:
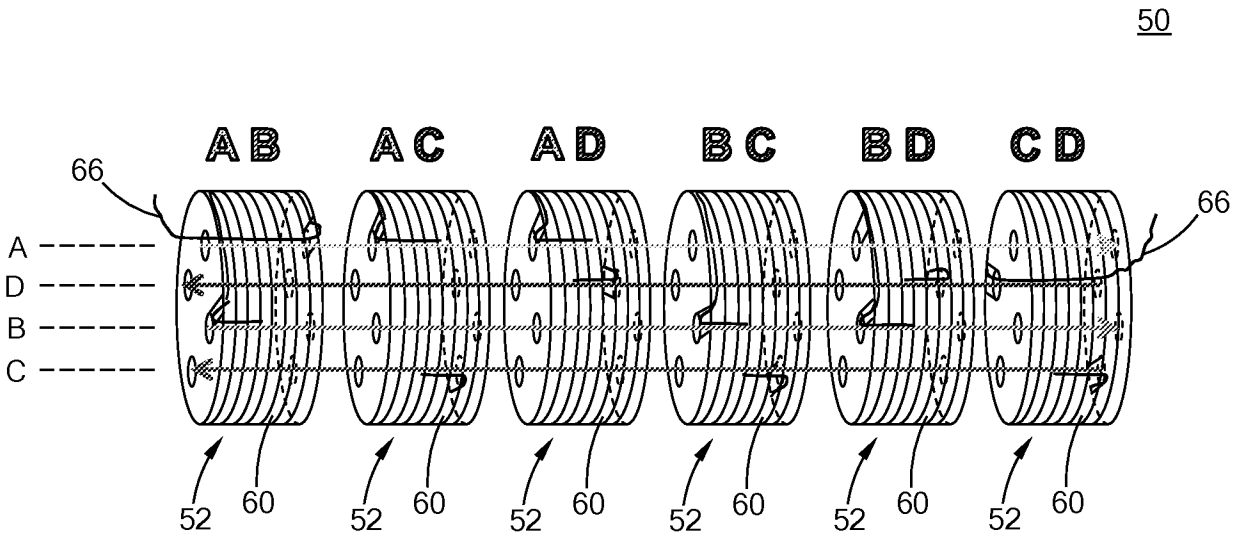
FIG. 5 is a view similar to FIG. 3, showing connection between a plurality of resistive elements, a plurality of power conductors, and a pair of conductive wires.

Referring to FIG. 5, the connection between the six heater units 52 and the four power conductors 56 is explained below. To explain the connection between the power conductors 56 and the heating units 52, the power conductors are designated by reference letters A, B, C, D.

The resistive elements 60 of the heater units 52 are each connected to two of the four power conductors A, B, C, D. The resistive elements 60 of the plurality of heater units 52 are connected to different pair of power conductors. For example, the resistive elements 60 of the heater units 52, in the order from left to right of FIG. 5, are connected to power conductors A and B, power conductors A and C, power conductors A and D, power conductors B and C, power conductors B and D, and power conductors C and D, respectively. The resistive elements 60 of the heater units 52 adjacent to the longitudinal ends of the cartridge heater 50 are further connected to lead wires 66 which are connected to the two-wire controller 22 for determining the resistance of the resistive elements 60 disposed between the lead wires 66.

The power control module 26 (shown in FIG. 1 only) may include multi-zone algorithms to turn off or turn down the power level delivered to any of the plurality of power conductors A, B, C, D to thereby activate the corresponding heater units 52. For example, when the power control module 26 supplies power to only power conductors A and B and no power to power conductors C and D, only the heater unit 52 at the far left of FIG. 5 is activated to generate heat. When the power control module 26 supplies power to only power conductors A, B and C and no power to the power conductor D, only the two heater units 52 at the far left of FIG. 5 are activated to generate heat. By carefully modulating the power to each of the heater units 52 and consequently the heating zones, the overall reliability of the cartridge heater 50 can be improved. When a hot spot is detected at a particular heater unit 52 of the cartridge heater 50, the power supply to the particular heater unit 52 may be reduced to avoid failure of the particular heater unit 52, thereby improving safety.

A higher number of electrically distinct heating zones 62 may be created through multiplexing, polarity sensitive switching and other circuit topologies by the power control module 26. The power control module 26 may use multiplexing or various arrangements of thermal arrays to increase the number of heating zones within the cartridge heater 50 for a given number of power conductors. Using the thermal array system as the power control module 26 is disclosed in U.S. Pat. Nos. 9,123,755, 9,123,756, 9,177,840, 9,196,513, 9,123,756, 9,177,840, and 10,002,779. These patents are commonly assigned with the present application and the contents of which are incorporated herein by reference in their entirety.

Generally, the power control module 26 in one form includes a control system that periodically compares a measured resistance value against a reference temperature to adjust for resistance drift over time. The control system may also vary the voltage of the power signal to accommodate a range of resistances and watt densities of the various heaters described herein. The power control module 26 may further be one such as disclosed in copending application Ser. No 62/350,275, filed on Jun. 15, 2016, which is commonly owned with the present application and the entire contents of which are incorporated herein by reference in their entirety.

More specifically, the power control module 26 may include a control circuit or a microprocessor based controller configured to receive sensor measurements and implement a control algorithm based on the measurements. In some examples, the power control module 26 may measure an electrical characteristic of one or more of the resistive elements 60 in the plurality of heater units 52. Further, the power control module 26 may include and/or control a plurality of switches to determine how power is provided to each resistive element 60 of the heater units 52 based on the measurements.

Figure 6:
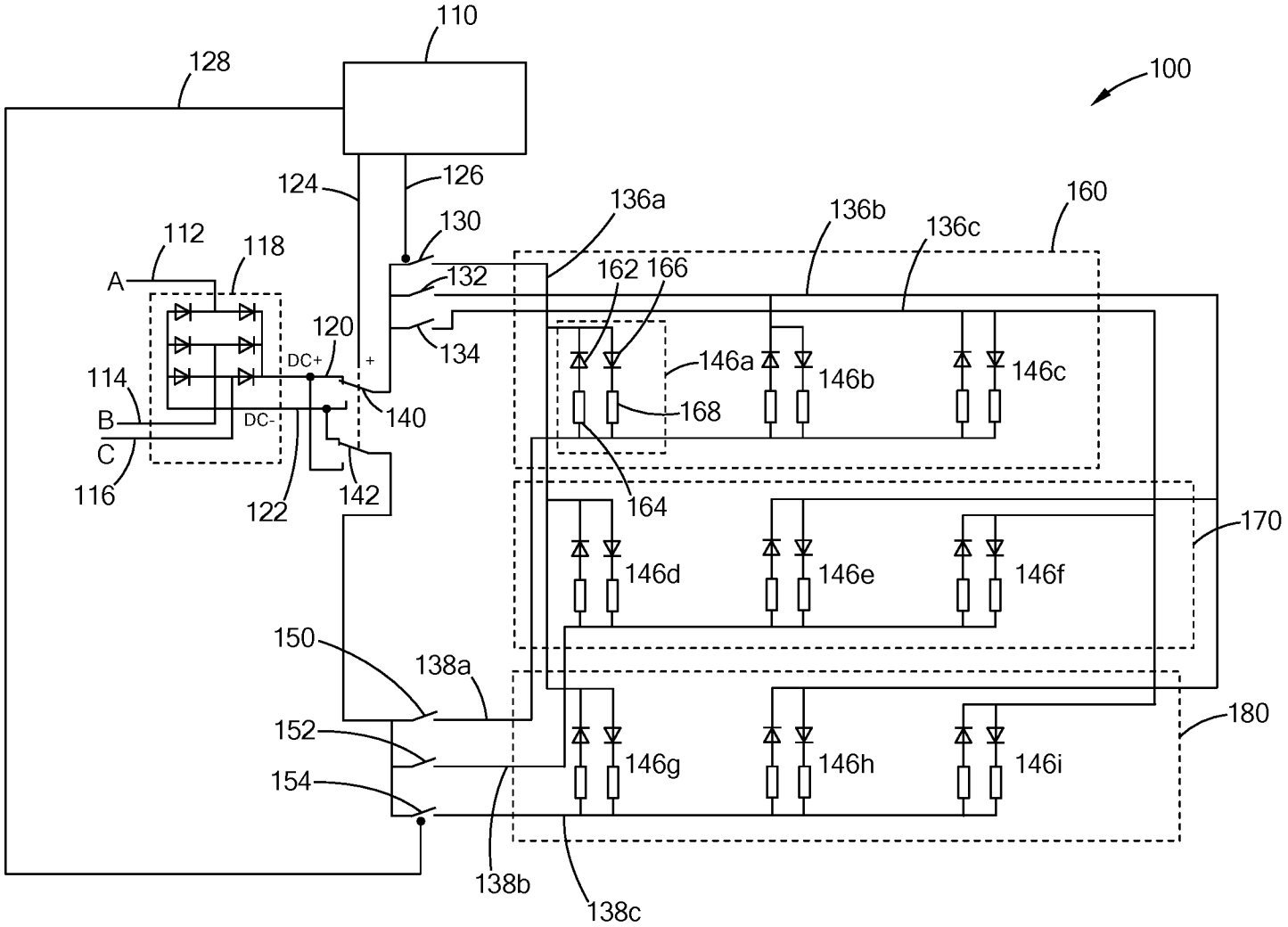
FIG. 6 is a schematic view of a bi-directional thermal array and a power control module for controlling the same used with the resistive elements and their materials according to the teachings of the present disclosure.

Referring to FIG. 6, the power control module 26 may have a plurality of power nodes 136*a*, 136*b*, 136*c*, 138*a*, 138*b*, 138*c*. The resistive elements 60 of the heater units 52 of FIG. 5 may be arranged similar to the thermal array 100 shown in FIG. 6, and thus may be connected between pairs of at least three power nodes. A resistive element of the plurality of resistive elements is connected between each pair of power nodes. The control scheme has been disclosed in Applicant's U.S. Pat. Nos. 9,123,756, 9,177,840, and 10,002,779,titled "Thermal Array System," the contents of which is incorporated herein by reference in its entirety.

More specifically, in one example, power is provided to the thermal array 100 through a three-phase power input as denoted by reference numerals 112, 114, 116. The input power may be connected to a rectifier circuit 118 to provide a positive direct current (DC) power line 120 and a negative DC power line 122. The power may be distributed to the thermal array through six power nodes. The controller 110 may be configured to control a plurality of switches, such that the positive power line 120 can be routed to any one of the six power nodes and the negative power line 122 can also be routed to any one of the plurality of power nodes.

In the implementation shown, the power nodes are configured into two groups of nodes. The first group of nodes includes power node 136*a*, power node 136*b*, and power node 136*c*. The second group includes power node 138*a*, power node 138*b*, and power node 138*c*. In the implementation shown, the thermal elements are configured into a matrix arrangement with three groups of thermal elements and each group containing six thermal elements. However, as with each implementation described herein, more or fewer nodes can be used and, further, the number of thermal elements may be correspondingly increased or decreased with the number of nodes.

As shown, the first group 160 of the thermal elements are all connected to node 138*a*. Similarly, the second group 170 of thermal elements are all connected to power node 138*b*, while the third group 180 of thermal elements are all connected to power node 138*c*. The thermal element may be heater elements. The heater elements may be formed of an electrically conductive material with, for example, a temperature dependent electrical resistance. More specifically, the thermal elements may be heater elements with an electrical characteristic, such as a resistance, capacitance, or inductance, that correlates to temperature. Although, the thermal elements may also generally be classified as dissipative elements, such as resistive elements.

Accordingly, the thermal elements in each of the implementations described herein may have any of the characteristics described above.

Within each group, the six thermal elements are configured into pairs of thermal elements. For example, in the first group 160, the first pair of thermal elements 146*a* includes a first thermal element 164 and a second thermal element 168. The first thermal element 164 is configured in electrical parallel connection with the second thermal element 168. Further, the first thermal element 164 is in electrical series connection with a unidirectional circuit 162. The unidirectional circuit 162 may be configured to allow current to flow through the thermal element 164 in one direction and not in the opposite direction. As such, the unidirectional circuit 162 is shown in its simplest form as a diode.

The first unidirectional circuit 162 is shown as a diode with the cathode connected to node 136*a* and the anode connected to node 138*a* through thermal element 164. In a similar manner, the second unidirectional circuit 166 is shown as a diode with a cathode connected to node 138*a* through the second thermal element 168 and an anode connected to node 136*a*, thereby illustrating the unidirectional nature of the first unidirectional circuit 162 being opposite to the second unidirectional circuit 166. It is noted that the implementation of a diode as a unidirectional circuit may only work for a one volt power supply, however, various other circuits may be devised including for example, circuits using silicon controlled-rectifiers (SCR's) that work for higher power supply voltages. Such implementations of unidirectional circuits are described in more detail below, but could be used in conjunction with any of the implementations described herein.

In a similar manner, the second thermal element 168 is in electrical series connection with a second unidirectional circuit 166, again in its simplest form shown as a diode. The first thermal element 164 and the first unidirectional circuit 162 are parallel with the second thermal element 168 and the second unidirectional circuit 166 between the power node 138*a* and power node 136*a*. Accordingly, if the controller 110 applies a positive voltage to node 136*a* and a negative voltage to node 138*a*, power will be applied across both the first thermal element 164 and the second thermal element 168 of the first pair 146*a*. As described above, the first unidirectional circuit 162 is oriented in an opposite direction of the second unidirectional circuit 166. As such, the first unidirectional circuit 162 allows current to flow through the first thermal element 164 when a positive voltage is applied to node 138*a* and a negative voltage is applied to node 136*a*, but prevents current from flowing when a positive voltage is provided to node 136*a* and a negative voltage is provided to node 138*a*. In contrast, when a positive voltage is applied to node 136*a* and a negative voltage is applied to 138*a*, current is allowed to flow through the second thermal element 168, however, current flow through the second thermal element 168 is prevented by the second unidirectional circuit 166 when the polarity is switched.

In addition, each pair of thermal elements within a group is connected to the different power node of the first group of power nodes 136*a*, 136*b*, 136*c*. Accordingly, the first pair of thermal elements 146*a* of the first group 160 is connected between node 136*a* and node 138*a*. The second pair of thermal elements 146*b* is connected between power node 136*b* and power node 138*a*, while the third pair 146*c* of thermal elements of group 160 is connected between power node 136*c* and power node 138*a*. As such, the controller 110 may be configured to select the group of elements by connecting power node 138*a* to supply power or return then the pair of thermal elements (146*a*, 146*b*, 146*c*) may be selected by connecting one of the nodes 136*a*, 136*b*, or 136*c*, respectively, to supply power or return. Further, the controller 110 may select to provide power to the first element of each pair or the second element of each pair based on the polarity of the voltage provided between node 138*a* and nodes 136*a*, 136*b*, and/or 136*c*.

In the same manner, the second group of thermal elements 170 are connected between node 138*b* of the second group of nodes, and node 136*a*, 136*b*, and 136*c*. As such, the first pair 146*d* of thermal elements of group 170 may be selected using power node 136*a*, while the second pair 146*e* and the third pair 146*f* of thermal elements of group 170 may be selected by node 136*b* and 136*c*, respectively.

Likewise, the second group of thermal elements 180 are connected between node 138*c* of the second group of nodes, and node 136*a*, 136*b*, and 136*c*. The first pair 146*g* of thermal elements of group 180 may be selected using power node 136*a*, while the second pair 146*h* and the third pair 146*i* of thermal elements of group 170 may be selected by node 136*b* and 136*c*, respectively.

For the implementation shown, the controller 110 manipulates a plurality of switches to connect the positive power line 120 to one of the first group of power nodes and the negative power line 122 to the second group of power nodes or, alternatively, connects the positive power line 120 to the second group of power nodes and the negative power line 122 to the first group of power nodes. As such, the controller 110 provides a control signal 124 to a first polarity control switch 140 and a second polarity control switch 142. The first polarity control switch 140 connects the first group of power nodes to either the positive power supply line 120 or the negative power supply line 122, while the second polarity switch 142 connects the second group of power nodes to the positive power supply line 120 or the negative power supply line 122.

In addition, the controller 110 provides control signals 126 to the first group power switches 130, 132, and 134. The switches 130, 132, and 134 connect the output of switch 140 (the positive supply line 120 or the negative supply line 122) to the first node 136*a*, the second node 136*b*, and the third node 136*c*, respectively. In addition, the controller 110 provides control signals 128 to the second group power switches 150, 152, and 154. The switches 150, 152, and 154 connect the output of switch 142 (the positive supply line 120 or the negative supply line 122) to the first node 138*a*, the second node 138*b*, and the third node 138*c*, respectively.

Therefore, the thermal elements (or the resistive elements) may be activated or deactivated by connecting the thermal elements to at least three power nodes, by controlling polarity of one node relative to another node, or by connecting the thermal elements to addressable switches.

While FIG. 6 shows sixteen (16) thermal elements are connected to the power control module, which includes a controller 110 and various power nodes and switches, it is understood that the number of thermal elements can be increased or decreased without departing from the scope of the present disclosure. For example, the resistive elements 60 of FIG. 5 can be properly arranged to form any one of the first, second and third groups 160, 170, 180 and are connected to the controller 110 and various power nodes and switches so that a controller 110 can be used to independently control activation or deactivation of the resistive elements.

With this structure, the plurality of heating zones 62 of the cartridge heater 50 can be controlled independently to vary the power output or heat distribution along the length of the cartridge heater 50. The power control module 26 can be configured to modulate power to each of the heating zones 62. For example, the plurality of heating zones 62 can be individually and dynamically controlled in response to various heating conditions and/or heating requirements, including but not limited to, the life and the reliability of the individual heater units 52, the sizes and costs of the heater units 52, local heater flux, characteristics and operation of the heater units 52, and the entire power output.

Each circuit is individually controlled at a desired temperature or a desired power level so that the distribution of temperature and/or power adapts to variations in system parameters (e.g. manufacturing variation/tolerances, changing environmental conditions, changing inlet flow conditions such as inlet temperature, inlet temperature distribution, flow velocity, velocity distribution, fluid composition, fluid heat capacity, etc.). More specifically, the heater units 52 may not generate the same heat output when operated under the same power level due to manufacturing variations as well as varied degrees of heater degradation over time. The heater units 52 may be independently controlled to adjust the heat output according to a desired heat distribution. The individual manufacturing tolerances of components of the heater system and assembly tolerances of the heater system are increased as a function of the modulated power of the power supply, or in other words, because of the high fidelity of heater control, manufacturing tolerance of individual components need not be as tight/narrow.

Figure 7:
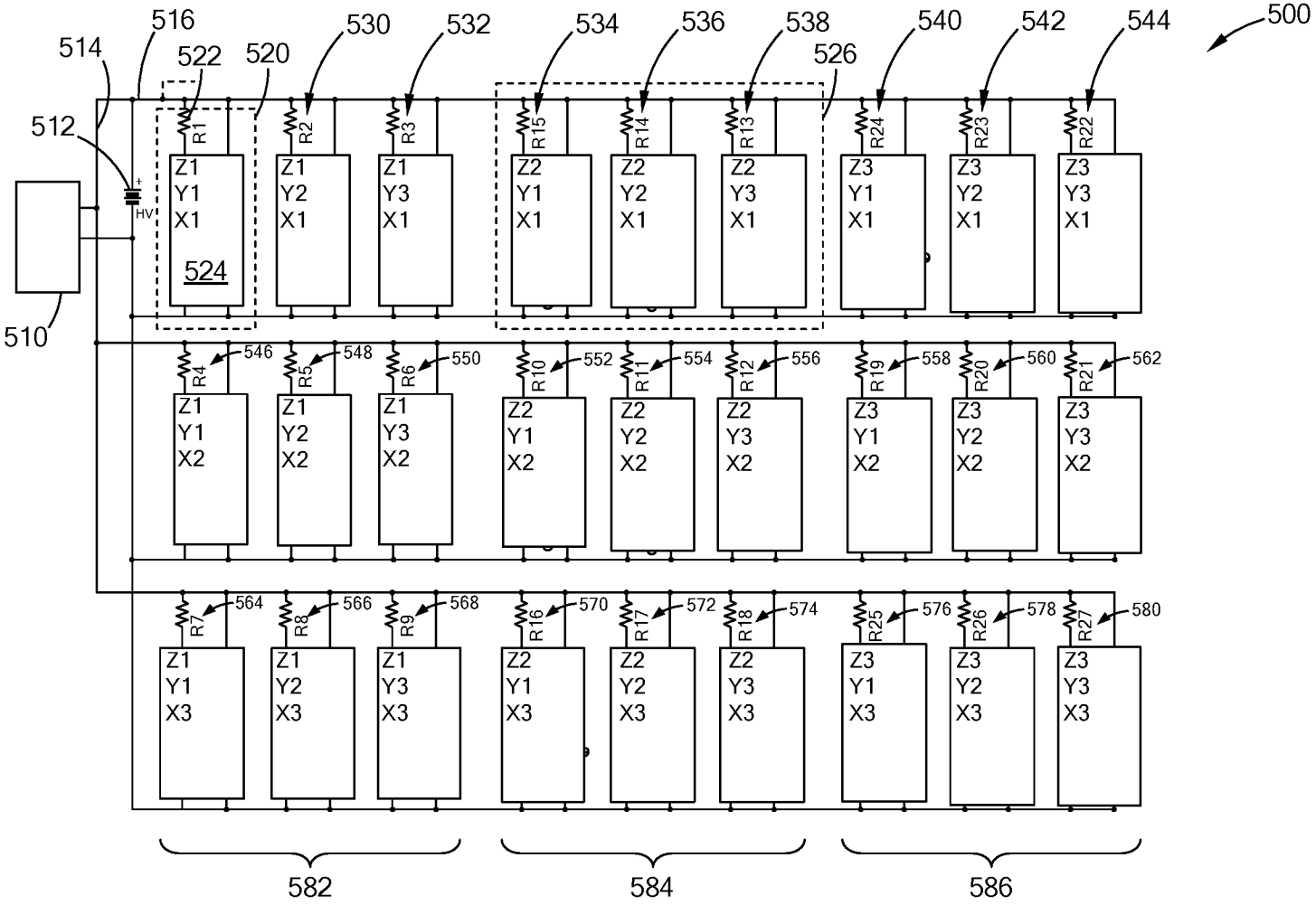
FIG. 7 is a schematic view of a thermal array using addressable switches for power control used with the resistive elements and their materials according to the teachings of the present disclosure.

Referring to FIG. 7, alternatively, each thermal element or resistive element 60 of FIG. 5 may be connected in electrical series with an addressable switch between the positive node 514 and the negative node 516. Each addressable switch may be a circuit of discreet elements including for example, transistors, comparators and SCR's or integrated devices for example, microprocessors, field-programmable gate arrays (FPGA's), or application specific integrated circuits (ASIC's). Signals may be provided to the addressable switches 524 through the positive node 514 and/or the negative node 516. For example, the power signal may be frequency modulated, amplitude modulated, duty cycle modulated, or include a carrier signal that provides a switch identification indicating the identity of the switch or switches to be currently activated. In addition, various commands for example, a switch on, switch off, or calibration commands could be provided over the same communication medium. In one example, three identifiers could be communicated to all of the addressable switches allowing control of 27 addressable switches and, thereby, activating or deactivating 27 thermal elements independently. Each thermal element 522 and addressable switch 524 form an addressable module 520 connected between the positive node 514 of the negative node 516. Each addressable switch may receive power and communication from the power lines and, therefore, may also separately be connected to the first node 514 and/or the second node 516.

Each of the addressable modules may have a unique ID and may be separated into groups based on each identifier. For example, all of the addressable modules (520, 530, 532, 534, 536, 538, 540, 542, and 544) in the first row may have a first or x identifier of one. Similarly, all of the addressable modules (546, 548, 550, 552, 554, 556, 558, 560, 562) in the second row may have an x identifier of two, while the modules (564, 566, 568, 570, 572, 574, 576, 578, 580) in the third row have an x identifier of three. In the same manner, the first three columns 582 of addressable modules (520, 530, 532, 546, 548, 550, 564, 566, 568) may have a z identifier of one. Meanwhile, the second three columns 584 may have a z identifier of two, while the third three columns 586 may have a z identifier of three. Similarly, to address each module within the group, each addressable module has a unique y identifier within each group. For example, in group 526, addressable module 534 has a y identifier of one, addressable module 536 has a y identifier of two, and addressable module 538 has a y identifier of three.

Figure 8:
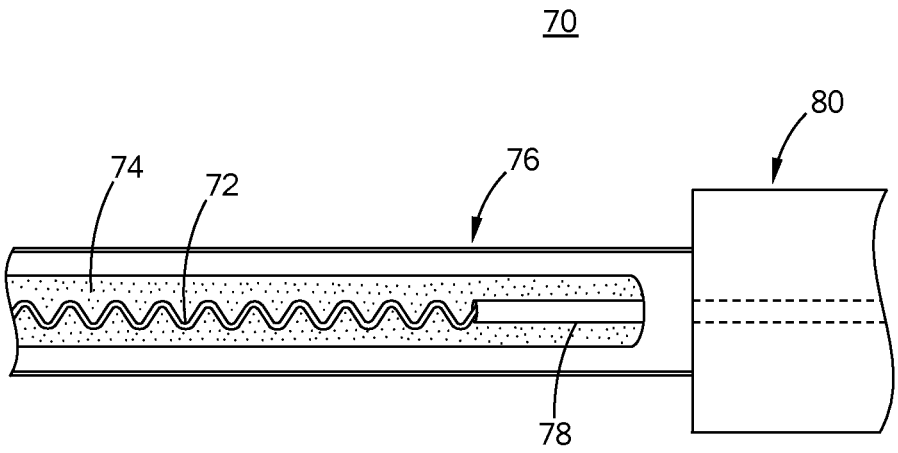
FIG. 8 is a schematic view of a tubular heater using the resistive materials and/or controls according to still another form of the present disclosure.

Referring to FIG. 8, a heater 70 according to another form of the present disclosure may be a tubular heater, which includes a resistive element 72 in the form of a coil, an insulating material 74 surrounding the resistive element 72, and a tubular sheath 76 surrounding the insulating material 74. The insulating material may be a material with a desired dielectric strength, heat conductivity and life and may include magnesium oxide (MgO). The resistive element 72 is connected to a pair of power conducting pins 78 (only one is shown in FIG. 7) which protrude from the tubular sheath 76 for connecting to the two-wire controller 24 (shown in FIG. 1) via the pair of electrical leads 28 (shown in FIG. 1). The resistive element 72 generates heat, which is transferred to the tubular sheath 76, which in turn heats a surrounding environment or part. The tubular heater 70 may further include a mounting member 80 for mounting the tubular heater 70 to a device, such as a wall of a semiconductor processing chamber.

Similar to the resistive element 34 of FIG. 1, the resistance element 72 may include a material selected from the group consisting of nickel, stainless steel, a molybdenum-nickel alloy, niobium, a nickel-iron alloy, tantalum, zirconium, platinum, molybdenum, titanium, a nickel copper alloy, or Nisil, among others. The resistive element 72 including relatively high TCR enables resistance feedback control via only two wires (i.e., the pair of electrical leads 28). To avoid or reduce thermal drift, the resistive element 72 may further include a coating selected from a group consisting of Nickel, Nickel-Chromium alloys, Iron-Chromium-Aluminum alloys, nickel aluminides, and precious metals. The coating can provide greater stability while maintaining high enough TCR to be used as a temperature sensor.

In one form of the tubular heater 70, the resistance element 72 is a material having greater than about 95% nickel and having a mineral insulation such as MgO as set forth above, and a metal material for the sheath 76. This specific heater construction provides improved resistance stability and heater control. In another form of the present disclosure, this tubular heater construction may further be combined with controls technologies, including the various forms of the power control module and controllers as set forth herein, such that certain material characteristics, such as temperature drift, can be compensated for by the controllers/power control modules.

Figure 9:
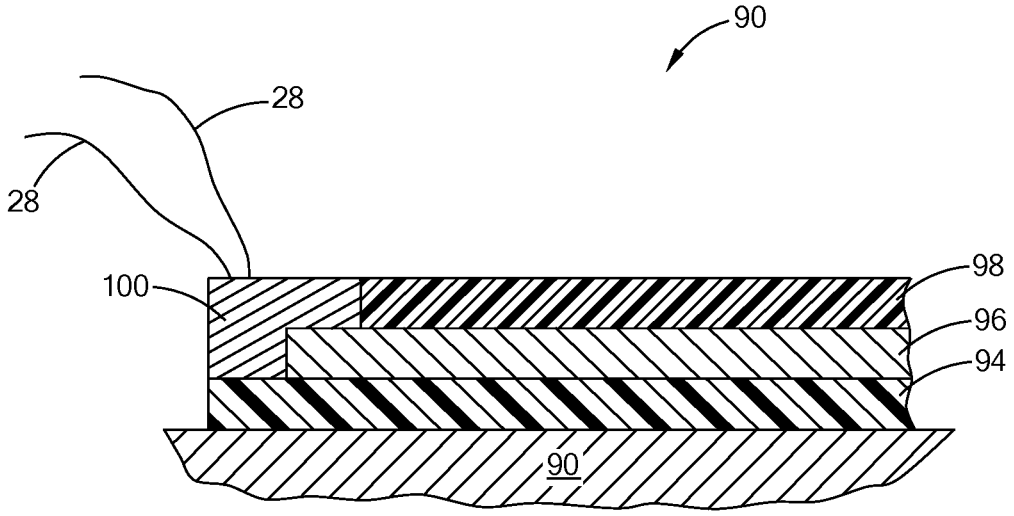
FIG. 9 is a schematic cross-sectional view of a layered heater using the resistive materials and/or controls according to another form of the present disclosure.

Referring to FIG. 9, a heater according to another form of the present disclosure may be a layered heater 90 including a number of layers disposed on a substrate 92, wherein the substrate 92 may be a separate element disposed proximate the part or device to be heated, or the part or device itself. A layered heater is one that includes at least one functional layer formed by a layered process, which involves accumulation or deposition of a material to a substrate or another layer. A layered process may be a thick film, thin film, thermal spraying, or sol-gel process, among others.

As shown, the layers in one form comprise a dielectric layer 94, a resistive layer 96, and a protective layer 96. The dielectric layer 94 provides electrical isolation between the substrate 92 and the resistive layer 96 and is disposed on the substrate 92 in a thickness commensurate with the power output of the layered heater 90. The resistive layer 96 is disposed on the dielectric layer 92 and provides two primary functions in accordance with the present disclosure. First, the resistive layer 96 is a resistive heater circuit for the layered heater 90, thereby providing the heat to the substrate 92. Second, the resistive layer 96 is also a temperature sensor, wherein the resistance of the resistive layer 96 is used to determine the temperature of the layered heater 90. The protective layer 98 is in one form an insulator, however other materials such as a conductive material may also be employed according to the requirements of a specific heating application while remaining within the scope of the present disclosure.

Terminal pads 100 are disposed on the dielectric layer 22 and are in contact with the resistive layer 96. Accordingly, electrical leads 102 are in contact with the terminal pads 100 and connect the resistive layer 96 to the two-wire controller 22 (shown in FIG. 1) for power input and for transmission of heater temperature information to the two-wire controller 14. Further, the protective layer 26 is disposed over the resistive layer 96 and is in one form a dielectric material for electrical isolation and protection of the resistive layer 96 from the operating environment. Since the resistive layer 96 functions as both a heating element and a temperature sensor, only one set of electrical leads 28, (e.g., two wires), are required for the heater system, rather than one set for the layered heater 90 and another set for a separate temperature sensor. Thus, the number of electrical leads for any given heater system is reduced by 50% through the use of the heater system according to the present disclosure. Additionally, since the entire resistive layer 96 is a temperature sensor in addition to a heater element, temperature is sensed throughout the entire heater element rather than at a single point as with many conventional temperature sensors such as a thermocouple.

Similar to the resistive element 34 of FIG. 1, the resistive layer 94 may include a material selected from the group consisting of nickel, stainless steel, a molybdenum-nickel alloy, niobium, a nickel-iron alloy, tantalum, zirconium, tungsten, molybdenum. The resistive layer 94 including relatively high TCR enables resistance feedback control via only two wires (i.e., the pair of electrical leads 28).

It is understood that the resistive element having a high TCR and/or having a coating to reduce thermal drift may be applied in any of the heaters known in the art and is not limited to the cartridge heater, the tubular heater, the cable heater, and the layered heater as described herein, or further may be applied to a silicon-rubber heater.

As a person skilled in the art will readily appreciate, the above description is meant as an illustration of the principles of the disclosure. This description is not intended to limit the scope or application of the disclosure in that the disclosure is susceptible to modification, variation and change, without departing from spirit of the disclosure, as defined in the following claims.

What is claimed is:

1. A heater system comprising:

a resistive element with a temperature coefficient of resistance (TCR) of at least about 1,000 ppm such that the resistive element functions as a heater and as a temperature sensor, the resistive element being a material having greater than about 95% nickel; and a heater control module including a two-wire controller with a power control module that is configured to periodically compare a measured resistance value of the resistive element against a reference temperature to adjust for resistance drift over time during operation such that a temperature drift of the resistive element is less than about 1% over a temperature range of about 500° C.-1,000° C.

2. The heater system according to claim 1 further comprising an insulation material surrounding the resistive element and a sheath surrounding the insulation material.

3. The heater system according to claim 2, wherein the insulation material includes MgO and the sheath is a metal material.

4. The heater system according to claim 1, wherein the resistive element further comprises a coating material selected from the group consisting of Nickel, Nickel alloys, Nickel-Chromium alloys, Iron-Chromium-Aluminum alloys, nickel aluminides, Cobalt alloys, Iron alloys, and precious metals.

5. The heater system according to claim 1, wherein the resistive element comprises a coating material selected from the group consisting of nickel, nickel alloys, nickel-chromium alloys, iron-chromium-aluminum alloys, nickel aluminides, cobalt alloys, iron alloys, and precious metals.

6. The heater system according to claim 1 further comprising a plurality of resistive elements having a TCR of at least about 1,000 ppm and being a material having greater than about 95% nickel.

7. The heater system according to claim 6 further comprising a power control module having a plurality of power nodes, wherein each resistive element is connected between a first power node and a second power node of the plurality of power nodes, each resistive element being connected with an addressable switch configured to activate and deactivate the resistive element, wherein each resistive element is independently controlled by the power control module.

8. The heater system according to claim 6 further comprising a power control module having at least three power nodes, wherein a resistive element of the plurality of resistive elements is connected between each pair of power nodes.

9. The heater system according to claim 6 further comprising a power control module having a plurality of power nodes, wherein a first resistive element and a second resistive element of the plurality of resistive elements is connected between a first node and a second node, the first resistive element being activated and the second resistive element being deactivated by a first polarity of the first node relative to the second node, the first resistive element being deactivated and the second resistive element being activated by a second polarity of the first node relative to the second node.

10. The heater system according to claim 1 further comprising a plurality of resistive elements having a TCR of at least about 1,000 ppm and being a material having greater than about 95% nickel, and a plurality of independently controllable zones, each independently controllable zone including at least one of the plurality of resistive elements.

11. The heater system according to claim 1, wherein the resistive element is a material selected from the group consisting of nickel, a nickel copper alloy, stainless steel, a molybdenum-nickel alloy, niobium, a nickel-iron alloy, tantalum, zirconium, tungsten, molybdenum, stainless steel, Nisil, and titanium.

12. The heater system according to claim 1, wherein the resistive element is formed by a layered process.

13. A heater system comprising:

a plurality of resistive elements having a TCR of at least about 1,000 ppm and being a material having greater than about 95% nickel such that each resistive element functions as a heater and as a temperature sensor; and a heater control module including a two-wire controller with a power control module having a plurality of power nodes, wherein the power control module is configured to periodically compare a measured resistance value of each of the resistive elements against a reference temperature to adjust for resistance drift over time during operation such that a temperature drift of each of the plurality of resistive elements is less than about 1% over a temperature range of about 500° C.-1,000° C.

14. The heater system according to claim 13, wherein the heater system further comprises a plurality of independently controllable zones, each independently controllable zone including at least one of the plurality of resistive elements.

15. The heater system according to claim 13, wherein each resistive element is connected between a first power node and a second power node of the plurality of power nodes, each resistive element being connected with an addressable switch configured to activate and deactivate the resistive element, wherein each resistive element is independently controlled by the power control module.

16. The heater system according to claim 13, wherein a first resistive element and a second resistive element of the plurality of resistive elements is connected between a first node and a second node, the first resistive element being activated and the second resistive element being deactivated by a first polarity of the first node relative to the second node, the first resistive element being deactivated and the second resistive element being activated by a second polarity of the first node relative to the second node.

17. The heater system according to claim 13 further comprising an insulation material surrounding each of the plurality of resistive elements and a sheath surrounding the insulation material, wherein the insulation material includes MgO and the sheath is a metal material.

18. A heater for use in a heater system comprising:

a resistive element with a temperature coefficient of resistance (TCR) of at least 1,000 ppm such that the resistive element functions as a heater and as a temperature sensor, the resistive element being a material having greater than about 95% nickel, wherein a heater control module including a two-wire controller with a power control module periodically compares a measured resistance value of the resistive element against a reference temperature to adjust for resistance drift over time during operation such that a temperature drift of the resistive element is less than about 1% over a temperature range of about 500° C.-1,000° C.

19. The heater according to claim 18 further comprising a plurality of resistive elements connected between a first power node and a second power node of a plurality of power nodes, each resistive element being connected with an addressable switch configured to activate and deactivate the resistive element, wherein each resistive element is independently controlled by a power control module.

20. The heater according to claim 18, wherein the resistive element comprises a coating material selected from the group consisting of nickel, nickel alloys, nickel-chromium alloys, iron-chromium-aluminum alloys, nickel aluminides, cobalt alloys, iron alloys, and precious metals.

* * * * *